US009458599B2

(12) United States Patent
Costello

(10) Patent No.: US 9,458,599 B2
(45) Date of Patent: Oct. 4, 2016

(54) METHOD AND APPARATUS FOR EARTH MOVING AND SURFACE GRADING

(71) Applicant: Gregory P. Costello, Lakeland, LA (US)

(72) Inventor: Gregory P. Costello, Lakeland, LA (US)

( * ) Notice: Subject to any disclaimer, the term of this patent is extended or adjusted under 35 U.S.C. 154(b) by 0 days.

(21) Appl. No.: 14/949,188

(22) Filed: Nov. 23, 2015

(65) Prior Publication Data

US 2016/0076217 A1 Mar. 17, 2016

Related U.S. Application Data

(63) Continuation-in-part of application No. 14/688,063, filed on Apr. 16, 2015, now Pat. No. 9,194,101.

(60) Provisional application No. 61/980,657, filed on Apr. 17, 2014, provisional application No. 62/006,486, filed on Jun. 2, 2014.

(51) Int. Cl.

| | |
|---|---|
| ***E02F 3/76*** | (2006.01) |
| ***E02F 3/84*** | (2006.01) |
| ***E02F 9/22*** | (2006.01) |
| ***F15B 15/14*** | (2006.01) |
| ***F15B 21/00*** | (2006.01) |

(52) U.S. Cl.

CPC ..... *E02F 3/844* (2013.01); *E02F 9/2271* (2013.01); *E02F 9/2296* (2013.01); *F15B 15/14* (2013.01); *F15B 21/00* (2013.01)

(58) Field of Classification Search

CPC .... A01B 3/464; A01B 3/4215; A01B 63/32; A01B 73/00; A01B 73/02; A01D 78/1007; E02F 3/7618; E02F 3/764; E02F 3/765; E02F 3/845; E02F 3/844; E02F 9/2296

USPC ..... 172/2–11, 212, 225, 776–781, 819–826

See application file for complete search history.

(56) References Cited

U.S. PATENT DOCUMENTS

| | | | | |
|---|---|---|---|---|
| 3,896,899 A * | 7/1975 | Scholl | E02F 3/845 | 172/4.5 |
| 4,603,745 A * | 8/1986 | Watvedt | A01B 3/464 | 172/212 |
| 4,825,958 A * | 5/1989 | Kelderman | A01B 73/00 | 172/311 |
| 5,769,768 A * | 6/1998 | Polacek | B23Q 3/15526 | 294/116 |
| 6,105,682 A * | 8/2000 | Recker | E02F 3/7618 | 172/811 |
| 6,286,606 B1 * | 9/2001 | Krieg | E02F 3/764 | 172/4.5 |
| 7,926,247 B2 * | 4/2011 | Van Den Engel | A01B 63/32 | 56/15.9 |

* cited by examiner

*Primary Examiner* — Robert Pezzuto
(74) *Attorney, Agent, or Firm* — Ted M. Anthony

(57) ABSTRACT

A tandem system having multiple fluid powered cylinders for operation of motor graders and other earth-moving equipment that is capable of interfacing with and being controlled by conventional two dimensional ("2-D") and three dimensional ("3-D") grade control systems, responds to encountered grade changes and adjusts elevation and a cross-slope to match predetermined project design specifications. Each cylinder member has at least one master area and at least one slave area.

17 Claims, 6 Drawing Sheets

METHOD AND APPARATUS FOR EARTH MOVING AND SURFACE GRADING

CROSS REFERENCES TO RELATED APPLICATIONS

This application is a continuation-in-part of U.S. patent application Ser. No. 14/688,063, filed Apr. 16, 2015, currently pending, which claims priority of U.S. Provisional Patent Application Ser. No. 61/980,657, filed Apr. 17, 2014, and U.S. Provisional Patent Application Ser. No. 62/006,486, filed Jun. 2, 2014, both incorporated herein by reference.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a tandem control and operating assembly for use in achieving a desired grade (including, without limitation, a precise final grade) on a variety of earth moving applications. More particularly, the present invention pertains to a tandem phasing hydraulic assembly for use in elevation and cross-slope tilt control on earth moving equipment, using a 2-D (two dimensional) or 3-D (three dimensional) machine control grading system.

2. Brief Description of the Related Art

Earth-moving projects can encompass a wide variety of excavating, trenching, boring, scraping, spreading and other tasks, which are performed in connection with road-building, infrastructure improvements, construction, mining and other activities. During earth-moving operations, a wide variety of equipment can be used for specific applications. Such equipment can include, without limitation, excavators, backhoes, bulldozers, loaders and motor graders.

One such earth-moving process is commonly referred to as "grading." Grading is frequently used during construction operations in order to create a smooth base having a designed surface slope. The grading process is typically used in connection with many different earth-moving projects including, without limitation, construction or reconditioning of sports fields, planar and non-planar commercial parking areas, residential subdivisions, roadways, agricultural areas and the like. Design parameters such as water runoff, slope, compaction (typically for load-bearing capacity) and thicknesses of various material layers, represent important grading and site design criteria.

In most instances, such grading operations typically involve a combination of "cutting" (that is, removal of earth or other materials) and "filling" (that is, placement of earth or other materials) operations that are required in order to achieve a final grading plan. During grading operations, cut and fill quantities are preferably beneficially balanced in order to avoid inefficiencies associated with obtaining additional fill material or removing excess material.

During grading and other earth-moving operations, mobile equipment generally must be steered and/or otherwise guided within a particular jobsite, while the working components of such equipment (such as, for example, blades, buckets and/or ground-engaging tools) must be controlled through their respective ranges of motion. Such steering, guidance and control have historically been accomplished by human operators; such human operators typically require relatively high levels of skill, training and experience for achieving desired results piloting such earth-moving equipment.

More recently, three-dimensional machine controlled guidance systems have been developed in order to provide automated control of such earth moving equipment. Such machine controlled guidance technology can be used to reduce human control, thereby increasing earth-moving efficiency and overall job quality. In many instances, such technology utilizes a global positioning system ("GPS"), as well as other measurement control systems, in order to automatically guide and control equipment used to place, level and/or compact dirt and other materials.

So-called "fully automatic" three-dimensional machine controlled guidance systems permit automated operation of earth moving equipment, as well as the working components thereof, in order to conform to a predetermined site plan. Such site plan, typically created by an engineering or other design firm, can be imported into said three-dimensional machine controlled guidance system. Thereafter, said earth moving equipment and the associated working components can be automatically controlled and oriented in order to move dirt or other materials to match said predetermined site plan.

Generally, cutting edges of earth-moving equipment are positioned using fluid powered (typically hydraulic) drive cylinders. Such drive cylinders are used to move blades and other working components up and down, and to adjust vertical and horizontal angles of such blades and other components. With fully automatic three-dimensional machine controlled guidance systems, control fluid for such drive cylinders is directed to and from said cylinders using electrically actuated servo-type valves which, in turn, are controlled by a computer-driven operating system.

Onboard computers and operating software can utilize satellite GPS positioning information, as well as predetermined design data, in order to guide earth-moving equipment around a job site and automatically adjust positioning of working components of such equipment. Sonic and/or laser sensors can also be used to provide information, such as distance, elevation or proximity measurement, to said three-dimensional machine controlled guidance systems. Such information is provided to computer processor(s) which process such information and electronically control said servo valves which, in turn, control fluid powered drive cylinders. In this manner, cutting edge(s) of working components can be automatically moved or adjusted to match predetermined job parameters.

Unfortunately, conventional earth moving devices equipped with double action fluid powered drive cylinders suffer from some significant limitations. Such conventional cylinders typically include a relatively large number of moving parts that eventually wear or fail, including, but not limited to, pivot pins, bushings, bearings, hoses, and hydraulic fittings. Such failures generally give rise to costly down time and a frequent need for expensive and time consuming repairs.

Further, conventional double action drive cylinders are generally supplied with fluid from a common fluid supply conduit; such fluid passes through a flow divider that is designed to split such fluid flow volume in a desired proportion (frequently, 50/50) between multiple cylinders. However, when earth moving equipment is subjected to uneven loading, such divided fluid flow will typically take a path of least resistance, causing said fluid split to deviate from said desired proportion. As a result, such conventional fluid powered double action drive cylinders are especially prone to failure when installed on scrapers and/or other earth moving equipment exposed to uneven distribution of dirt or other earth material and, thus, uneven loading.

Thus, there is a need for a robust earth moving assembly equipped with fluid powered cylinders capable of providing consistency, accuracy and repeatability in operation. Said earth moving assembly should beneficially utilize less moving parts than conventional equipment, thereby providing for a more durable and effective solution to earth moving applications.

SUMMARY OF THE INVENTION

The present invention comprises a tandem phasing assembly having a plurality of fluid powered work cylinder members. Although other fluid can be used, in a preferred embodiment said cylinder members are hydraulically powered. Said fluid powered cylinder members have a compact configuration and are capable of both elevation and a cross-slope control, as more fully described herein, that is independent of other fluid powered cylinder member(s).

The configuration of the fluid powered cylinder members of the present invention significantly reduces the number of moving parts, as compared to conventional systems, that are susceptible to wear or failure, including, but not limited to, pivot pins, bushings, bearings, hoses, and hydraulic fittings, thereby eliminating a need for expensive repairs and frequent down time.

Each cylinder member has at least one barrel member and a piston rod member slidably disposed within each of said at least one barrel members. Said rod members permit said cylinder members to operate independently of one another which, in turn, permits working components of associated earth moving equipment to have a desired orientation including, without limitation, a steep and aggressive tilt.

In a preferred embodiment, the tandem phasing assembly of the present invention is capable of interfacing with conventional two dimensional ("2-D") and three dimensional ("3-D") grade control systems that are currently available. Said tandem phasing assembly of the present invention responds to encountered grade changes from such a control system as an earth mover traverses across terrain and adjusts elevation and a cross-slope to match predetermined project design specifications.

Each function (blade elevation or side-to-side tilt) of the present invention is controlled by at least one pair of fluid powered cylinders, with each such pair of cylinders comprising at least one master cylinder and at least one slave cylinder. Each functional pair of cylinders (for example, elevation master and slave cylinders) is operationally attached to another functional pair of cylinders (for example, tilt master and slave cylinders) using a pivotal linkage member.

A hydraulic fluid communication conduit between said at least one master and said at least one slave cylinder permits said cylinders to work in tandem, and said earth moving equipment to maintain precise elevation and slope demands, even with a heavy one-sided material loading. By contrast, conventional double acting cylinders can routinely fail under such conditions.

When the tandem phasing hydraulics assembly of the present invention is utilized in connection with a bottomless drag scraper, material can be moved across a surface being graded, while said scraper is able to maintain a full load. Therefore, the present invention represents a significant improvement over conventional dozers and road grading equipment which frequently lose or waste material during operation because they do not have side walls to contain material.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
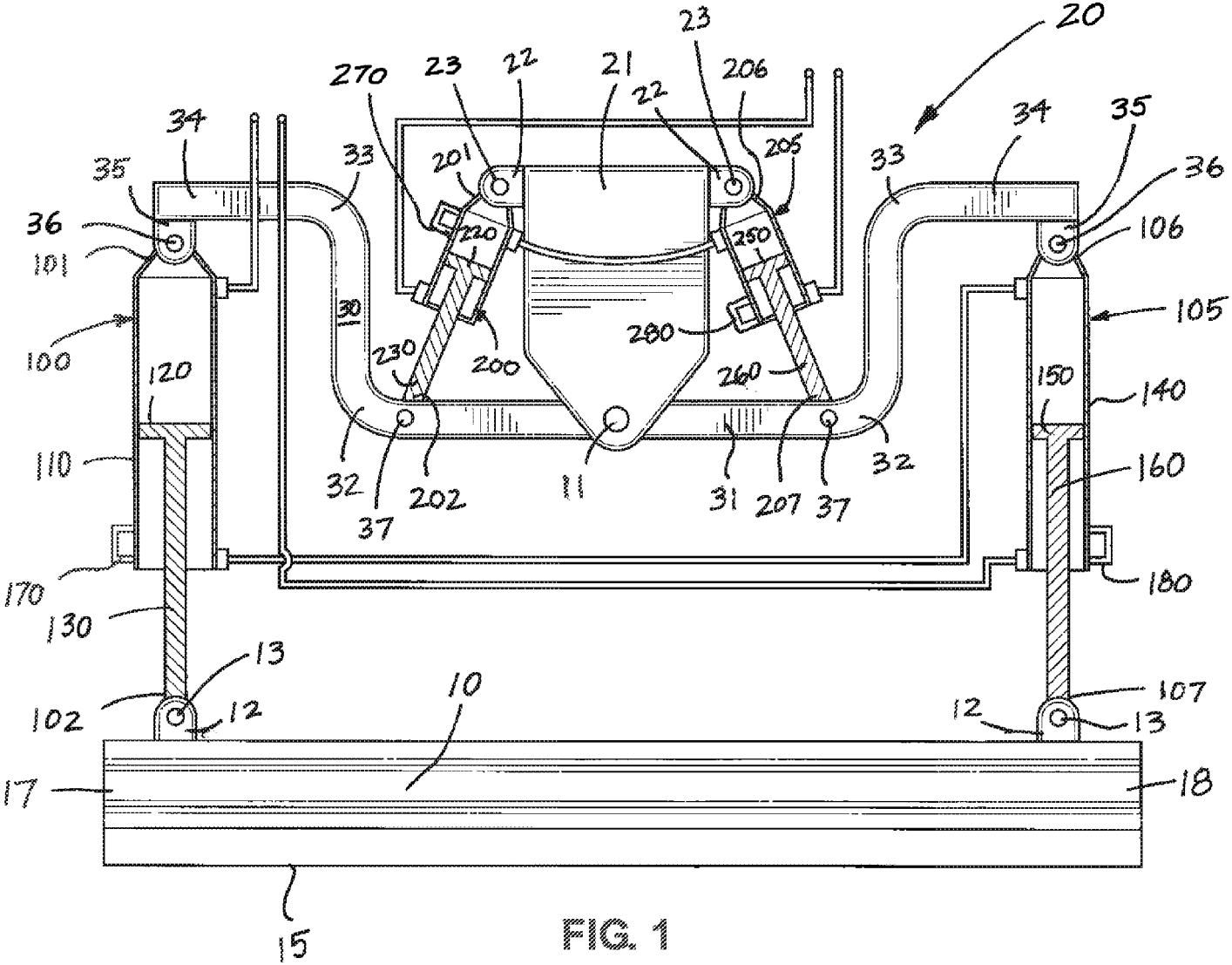
FIG. 1 depicts a front view of an earth moving grader assembly equipped with a pivotally mounted blade and the tandem phasing cylinder assembly of the present invention.

FIG. 1 depicts a front view of an earth moving grader assembly 20 equipped with a pivotally mounted blade and the tandem phasing cylinder assembly of the present invention. As depicted in FIG. 1, said earth moving grader assembly generally comprises a grader blade 10 and grader frame extension 21. Yoke member 30 is pivotally connected to grader frame extension 21 using pivot bolt 11; said yoke member 30 can pivot about a rotational axis passing through said pivot bolt 11.

Although grader frame extension 21 is depicted in the attached figures as a multi-sided plate-like member, it is to be observed that said grader frame extension 21 can embody numerous other shapes and/or configurations without departing from the scope of the present invention. In a preferred embodiment, said grader frame extension 21 should be securely attached to, or integrally formed with, an earth moving grader assembly in order to absorb and/or resist forces imparted on the various components of said earth moving grader assembly (including, without limitation, blade 10 and yoke member 30) during use.

In a preferred embodiment, yoke member 30 is substantially curved or bent, generally comprising base section 31, lower elbow sections 32, upper elbow sections 33 and lateral extension arms 34. Such a configuration permits greater range of movement of blade member 10 as described below. However, it is to be observed that the shape and/or configuration of said yoke member 30 can also be altered without departing from the scope of the present invention. By way of illustration, but not limitation, said yoke member can also be a substantially straight or flat member.

A master elevation fluid powered cylinder assembly 100 has an upper end 101 and a lower end 102. Said upper end 101 of said master fluid powered cylinder assembly 100 is pivotally attached to yoke member 30; in a preferred embodiment, said upper end 101 is operationally attached to mounting bracket 35 using pivot bolt 36. Lower end 102 of master elevation fluid powered cylinder 100 is pivotally attached to blade 10; in preferred embodiment, said lower end 102 is operationally attached to a blade mounting bracket 12 using pivot bolt 13.

Similarly, a slave elevation fluid powered cylinder assembly 105 has an upper end 106 and a lower end 107. Said upper end 106 of said slave elevation fluid powered cylinder assembly 105 is pivotally attached to yoke member 30; in a preferred embodiment, said upper end 106 is operationally attached to a mounting bracket 35 using a pivot bolt 36. Lower end 107 of slave elevation fluid powered cylinder 105 is pivotally attached to blade 10; in preferred embodiment, said lower end 107 is operationally attached to a blade mounting bracket 12 using pivot bolt 13.

A master tilt fluid powered cylinder assembly 200 has an upper end 201 and a lower end 202. Said upper end 201 of said master tilt fluid powered cylinder assembly 200 is pivotally attached to grader frame extension 21; in a preferred embodiment, said upper end 201 is operationally attached to mounting bracket 22 using pivot bolt 23. Lower end 202 of master tilt fluid powered cylinder 200 is pivotally attached to yoke member 30; in preferred embodiment, said lower end 202 is operationally attached to yoke member 30 using pivot bolt 37.

Similarly, a slave tilt fluid powered cylinder assembly 205 has an upper end 206 and a lower end 207. Said lower end 207 of said slave tilt fluid powered cylinder assembly 205 is pivotally attached to yoke member 30; in a preferred embodiment, said lower end 207 is operationally attached to yoke member 30 using a pivot bolt 37. Upper end 206 of slave tilt fluid powered cylinder 205 is pivotally attached to blade 10; in preferred embodiment, said upper end 206 is pivotally attached to grader frame extension 21; in a preferred embodiment, said upper end 206 is operationally attached to mounting a bracket 22 using pivot bolt 23.

Still referring to FIG. 1, blade member 10 (and, more particularly, lower cutting edge 15 thereof) can be disposed on an underlying surface. As depicted in FIG. 1, blade member 10 has left lateral end 17 and right lateral end 18. In most applications, said surface can be a job site or other location which at which dirt or other sediment is being moved or reconfigured. For example, said underlying work surface can be the upper surface of a plot of land or other area that is being graded using motorized earth moving equipment of the present invention.

Both master elevation fluid powered cylinder 100 and slave elevation fluid powered cylinder 105 can be extended or retracted as discussed in greater detail below. Such extension or retraction of said master and slave elevation fluid powered cylinders 100 and 105 permits blade member 10 to be selectively raised or lowered relative to said underlying work surface. Similarly, both master tilt fluid powered cylinder 200 and slave tilt fluid powered cylinder 205 can be extended or retracted as discussed in greater detail below. Such extension or retraction of said master and slave tilt fluid powered cylinders 200 and 205 permits blade member 10 to be selectively tilted from side to side relative to said underlying work surface.

Figure 2:
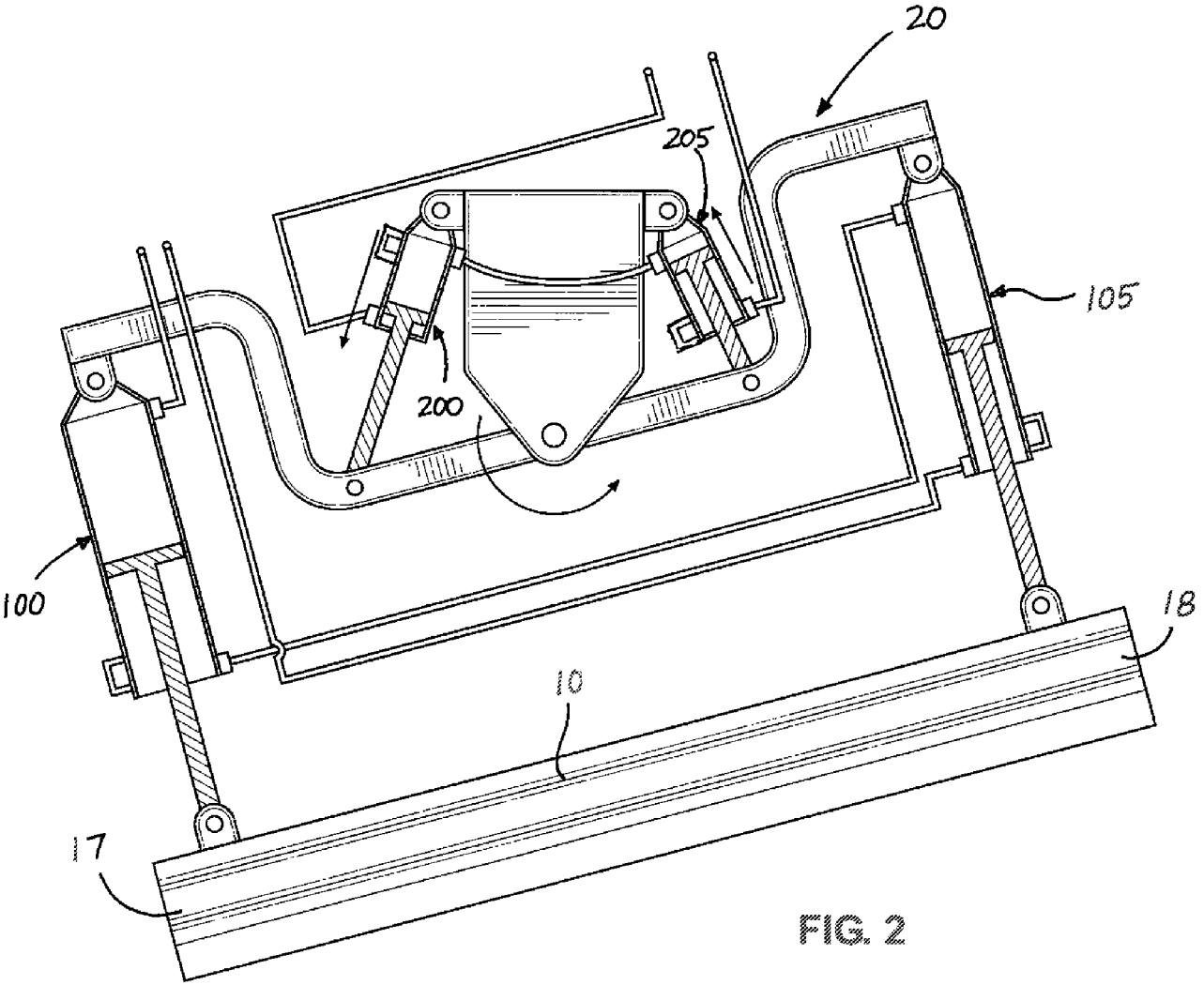
FIG. 2 depicts a front view of an earth moving grader assembly equipped a pivotally mounted blade and the tandem phasing cylinder assembly of the present invention, wherein the left side of said blade is tilted downward and the right side of said blade is tilted upward.

FIG. 2 depicts a front view of a grader assembly 20 equipped with a pivotally mounted grader blade and the tandem phasing cylinder assembly of the present invention, wherein left lateral end 17 of said blade 10 is tilted in a substantially downward direction and right lateral end 18 of said blade 10 is tilted in a substantially upward direction. As noted above, both master elevation fluid powered cylinder 100 and slave elevation fluid powered cylinder 105 can be extended or retracted which, in turn, permits blade member 10 to be selectively raised or lowered relative to an underlying work surface.

Still referring to FIG. 2, both master tilt fluid powered cylinder 200 and slave tilt fluid powered cylinder 205 can be extended or retracted. Such extension or retraction of said master tilt fluid powered cylinder 200 and slave tilt fluid powered cylinders 205 permits blade member 10 to be selectively tilted from side to side relative to an underlying work surface. As depicted in FIG. 2, extension of master tilt fluid power cylinder 200 and simultaneous retraction of slave tilt fluid power cylinder 205 causes the left lateral end 17 of blade 10 to be tilted in a substantially downward direction and the right lateral end 18 of said blade 10 to be tilted in a substantially upward direction.

Figure 3:
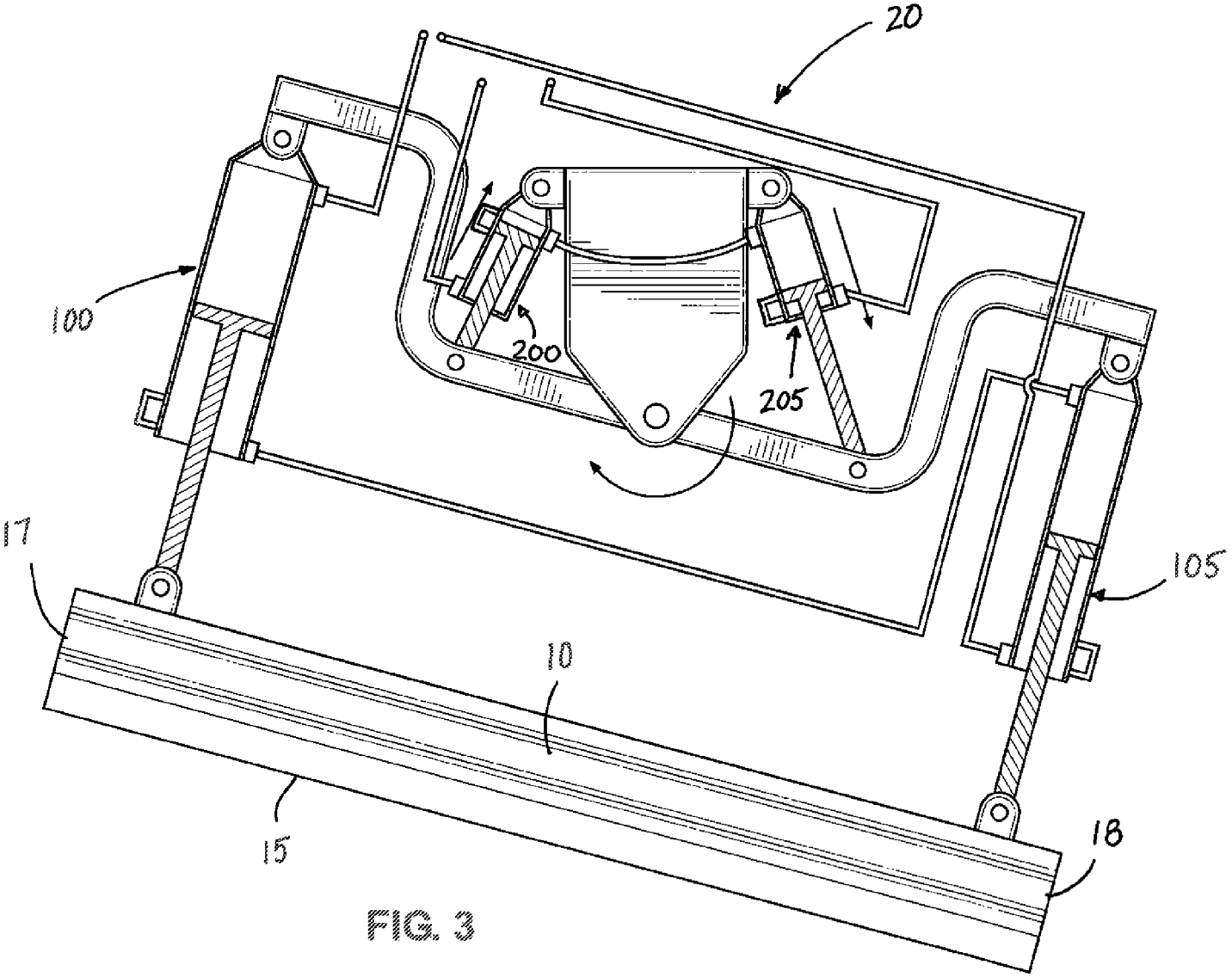
FIG. 3 depicts a front view of an earth moving grader assembly equipped with a pivotally mounted blade and the tandem phasing cylinder assembly of the present invention, wherein the left side of said blade is tilted upward and the right side of said blade is tilted downward.

FIG. 3 depicts a front view of an earth moving grader assembly equipped with a pivotally mounted blade 10 and the tandem phasing cylinder assembly 20 of the present invention, wherein blade member 10 is tilted in a substantially opposite side to side orientation compared to FIG. 2. As depicted in FIG. 3, retraction of master tilt fluid power cylinder 200 and simultaneous extension of slave tilt fluid power cylinder 205 causes left lateral end 17 of blade 10 to be tilted in a substantially upward direction, while right lateral end 18 of said blade 10 is tilted in a substantially downward direction.

Figure 4:
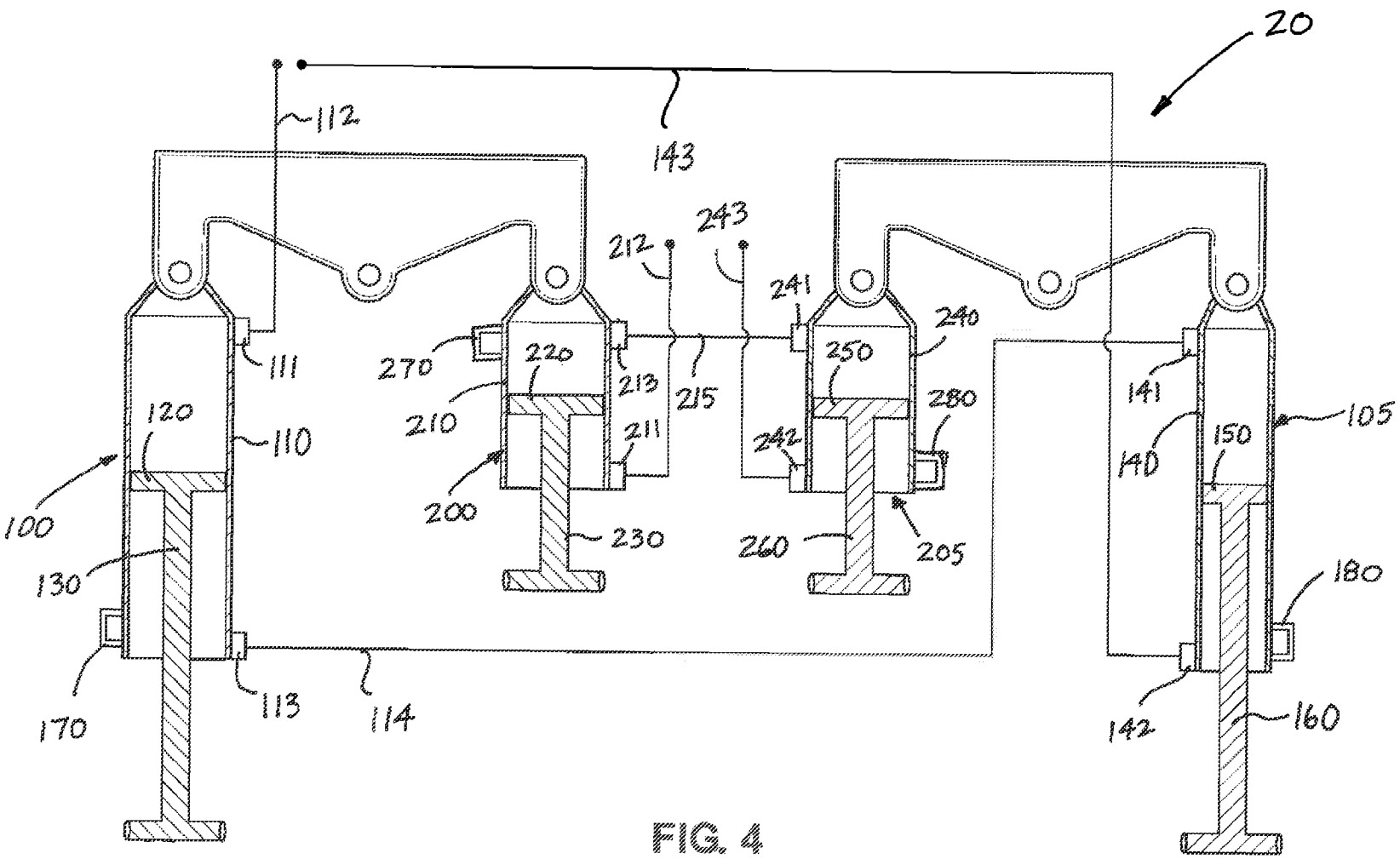
FIG. 4 depicts a schematic view of a hydraulic system of the present invention.

FIG. 4 depicts a schematic view of a hydraulic system of the tandem phasing cylinder assembly 20 of the present invention. As noted above, said tandem phasing cylinder assembly 20 can comprise a plurality of fluid powered cylinders that can be selectively extended or retracted. Although other control fluid could be used to power said cylinders, in a preferred embodiment said cylinders are powered using hydraulic fluid.

Still referring to FIG. 4, master elevation fluid powered cylinder assembly 100 comprises a master elevation barrel member 110, while slave elevation fluid powered cylinder assembly 105 comprises a slave elevation barrel member 140. Master elevation barrel member 110 and slave elevation barrel member 140 each define inner cylindrical chambers. Master elevation piston 120, operationally connected to master elevation piston rod 130, is slidably disposed within said inner chamber formed by master elevation barrel 110. Similarly, slave elevation piston 150, operationally connected to slave elevation piston rod 160, is slidably disposed within said inner chamber formed by slave elevation barrel 140.

Master tilt fluid powered cylinder assembly 200 comprises a master tilt barrel member 210, while slave tilt fluid powered cylinder 205 comprises a slave tilt barrel member 240. Master tilt barrel member 210 and slave tilt barrel member 240 each define inner cylindrical chambers. Master tilt piston 220, operationally connected to master tilt piston rod 230, is slidably disposed within said inner chamber formed by master barrel 210; slave tilt piston 250, operationally connected to slave tilt piston rod 260, is slidably disposed within said inner chamber formed by slave tilt barrel 240.

During operation, hydraulic fluid is provided to master elevation cylinder assembly 100 via conduit 112. Although specific configurations can vary, it is to be observed that said conduit 112 can extend from a hydraulic fluid pump supplied by a hydraulic fluid reservoir well known to those having skill in the art. Said fluid is supplied through fluid conduit 112 into the inner chamber of master elevation barrel 110 via fluid inlet fitting 111. As said fluid volume changes within master elevation barrel 110, master elevation piston 120 moves within said master elevation barrel 110, thereby causing master elevation piston rod 130 to extend or retract, as the case may be, relative to said master elevation barrel 110.

As more fluid enters said inner chamber of master elevation barrel 110, master elevation piston 120 forces fluid to flow out of fluid fitting 113 and through fluid conduit 114. Fluid supplied through fluid conduit 114 enters into the inner chamber of slave elevation barrel 140 via fluid inlet fitting 141. As said fluid volume changes within the inner chamber of slave elevation barrel 140, slave elevation piston 150 moves within said slave elevation barrel 140, thereby causing slave elevation piston rod 160 to extend relative to said slave elevation barrel 140. As more fluid enters said inner chamber of slave elevation barrel 140 via fluid fitting 141, slave elevation piston 150 forces fluid to flow out of fluid fitting 142 and through fluid conduit 143; said fluid is ultimately directed back to a hydraulic fluid reservoir utilized by an operating control system.

In a preferred embodiment, the diameter of master elevation barrel 110 is greater than the diameter of slave elevation barrel 140. As master elevation piston 120 expels a given volume of fluid out of fluid fitting 113, through fluid conduit 114 and into the inner chamber of slave elevation barrel 140, slave elevation piston 150 is displaced within slave elevation cylinder barrel 140 and slave elevation piston rod 160 extends. Said fluid exits master elevation barrel 110 below master elevation piston 120 (which includes master piston rod 130 in this part of master elevation barrel 110), and enters slave elevation barrel 140 above slave elevation piston 150 (which does not include slave piston rod 160 in this part of slave elevation barrel 140). Thus, in order to ensure that a given volume of fluid results in longitudinal displacement of said slave elevation piston rod 160 equal to that of master elevation piston rod 130—that is, to ensure that said rods 160 and 130 extend (or retract, in the case of reverse fluid flow) an equivalent distance in tandem synchronization with each other—the diameter of slave elevation cylinder barrel 140 is reduced.

Similarly, during operation, hydraulic fluid is likewise selectively provided to master tilt cylinder assembly 200 via conduit 212. Although specific configurations can vary, it is to be observed that said conduit 212 can extend from a hydraulic fluid pump supplied by a hydraulic fluid reservoir well known to those having skill in the art. Said fluid is supplied through fluid conduit 212 into the inner chamber of master tilt barrel 210 of master tilt cylinder member 200 via fluid inlet fitting 211. As said fluid volume varies within master tilt barrel 210, master tilt piston 220 moves within said master tilt barrel 210, thereby causing master tilt piston rod 230 to extend or retract relative to said master tilt barrel 210.

Generally, as said fluid volume varies within the inner chamber of slave tilt barrel 240, slave tilt piston 250 moves within said slave tilt barrel 240, thereby causing slave tilt piston rod 260 to extend or retract relative to said slave tilt barrel 240. As more fluid enters said inner chamber of master tilt barrel 210 via conduit 212, master tilt piston 220 forces fluid out of fluid fitting 213 and through fluid conduit 215. Fluid supplied through fluid conduit 215 enters into the inner chamber of slave tilt barrel 240 via fluid inlet fitting 241. As more fluid enters said inner chamber of slave tilt barrel 240, slave tilt piston 250 forces fluid out of fluid fitting 242 and through fluid conduit 243; said fluid is ultimately directed back to a hydraulic fluid reservoir utilized by an operating control system.

Referring back to FIG. 1, during operation, master elevation rod 130 of master elevation fluid powered cylinder 100 and slave rod 160 of slave elevation fluid powered cylinder 105 can be extended or retracted as desired. Such extension or retraction of said master and slave elevation fluid powered cylinder rods 130 and 160, respectively, permits blade member 10 to be selectively raised or lowered relative to an underlying work surface. Because of the tandem phased relationship of said master elevation fluid powered cylinder 100 and slave elevation fluid powered cylinder 105, rods 130 and 160 extend and retract in a synchronized manner, thereby permitting even elevation control of blade member 10 relative to an underlying surface.

Re-phasing ports extend through master elevation fluid powered cylinder 100 and slave elevation fluid powered cylinder 105. Re-phasing conduit 170 on master elevation fluid powered cylinder 100 and re-phasing conduit 180 on slave elevation fluid powered cylinder 105 ensure synchronization of tandem-operated elevation pistons 120 and 150, respectively, when piston rods 130 and 160 are fully extended; said rephrasing conduits 170 and 180 permit said pistons 120 and 150 to remain fully synchronized with each other.

Similarly, slave tilt rod 260 of slave tilt fluid powered cylinder 205 and master tilt rod 230 of master tilt fluid powered cylinder 200 can be extended or retracted as desired. Such extension or retraction of said cylinder rods permits blade member 10 to be selectively tilted from side-to-side relative to an underlying surface. Unlike master elevation rod 130 of master elevation fluid powered cylinder 100 and slave rod 160 of slave elevation fluid powered cylinder 105 (which extend and retract together), the strokes of slave tilt rod 260 and master tilt rod 230 are inversely related; when master tilt rod 230 is extends a particular distance, slave tilt rod 260 retracts a like distance, and vice versa.

Re-phasing ports extend through master tilt fluid powered cylinder 200 and slave tilt fluid powered cylinder 205. Re-phasing conduit 270 on master tilt fluid powered cylinder 200 and re-phasing conduit 280 on slave tilt fluid powered cylinder 205 ensure synchronization of tandem-operated tilt pistons 220 and 250 when master tilt rod 230 is fully collapsed and slave tilt rod 260 is fully extended; said rephrasing conduits 270 and 280 permit said pistons 220 and 250, respectively, to remain fully synchronized with each other.

Although other configurations can be envisioned without departing from the scope of the present invention, as depicted in FIGS. 1, 2 and 3, master elevation rod 130 of master elevation fluid powered cylinder 100 and slave elevation rod 160 of slave elevation fluid powered cylinder 105 control blade elevation relative to an underlying work surface, while slave tilt rod 260 of slave tilt fluid powered cylinder 205 and master tilt rod 230 of master tilt fluid powered cylinder 200 control blade side-to-side tilt relative to said underlying work surface. As depicted in FIG. 2, extension of master tilt fluid power cylinder 200 and simultaneous retraction of slave tilt fluid power cylinder 205 causes the left lateral end 17 of blade 10 to be tilted in a substantially downward direction and the right lateral end 18 of said blade 10 to be tilted in a substantially upward direction. As depicted in FIG. 3, retraction of master tilt fluid power cylinder 200 and simultaneous extension of slave tilt fluid power cylinder 205 causes left lateral end 17 of blade 10 to be tilted in a substantially upward direction, while right lateral end 18 of said blade 10 is tilted in a substantially downward direction.

Figure 5:
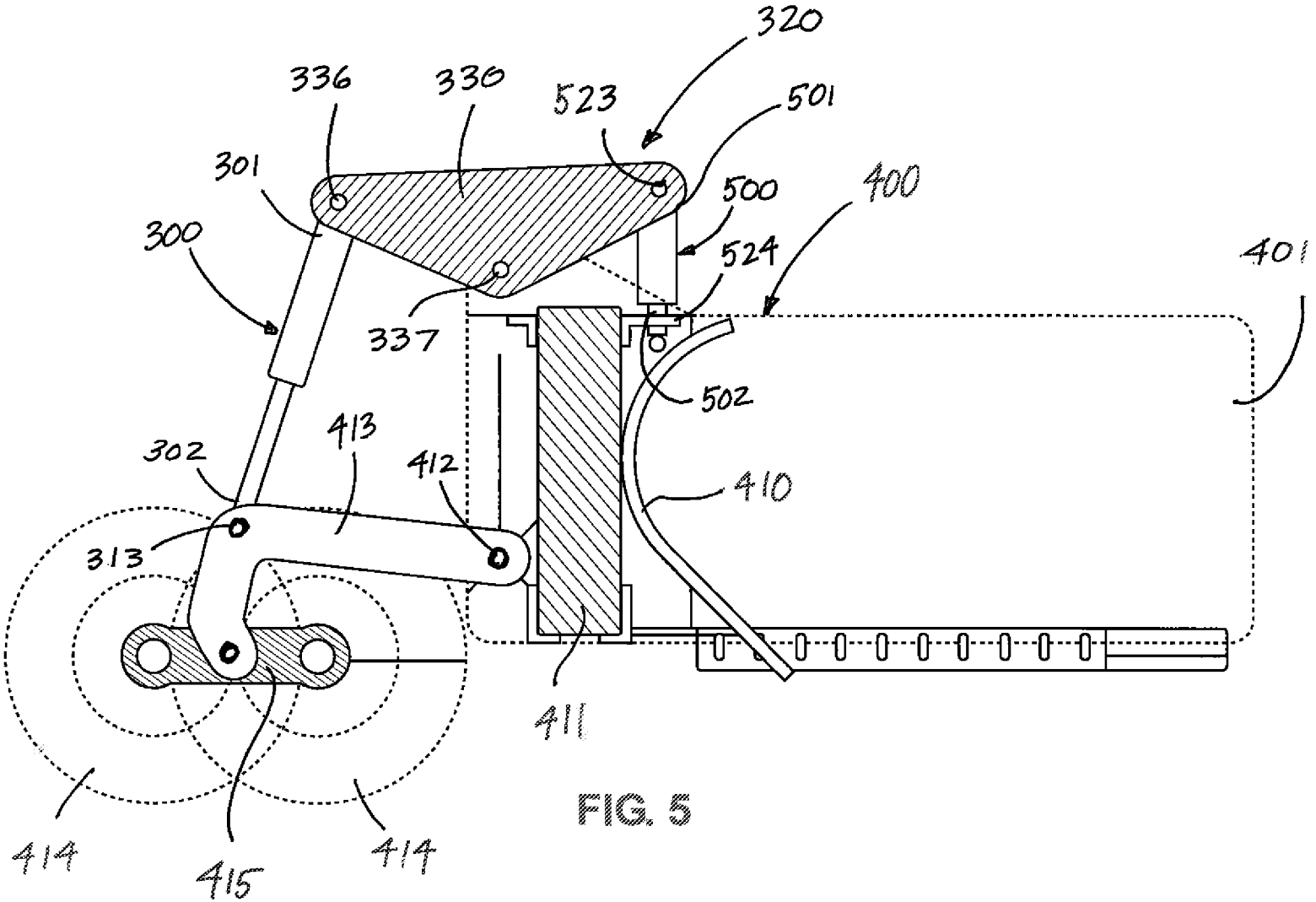
FIG. 5 depicts a side view of an alternative embodiment of an earth moving grader assembly equipped with the tandem phasing cylinder assembly of the present invention.

FIG. 5 depicts a side view of an alternative embodiment of an earth moving grader blade assembly 400 equipped with an alternative embodiment tandem phasing cylinder assembly 320 of the present invention. In the embodiment depicted in FIG. 5, body 401 of said earth moving grader blade assembly 400 can be attached to a power source (not pictured), such as a tractor, bull dozer or other powered mobile device using a conventional hitch; said earth moving grader blade assembly 400 can be pulled across an underlying work surface in order to smooth, grade or otherwise manipulate said underlying surface.

Although specific configurations can vary without departing from the scope of the present invention, grader blade assembly 400 generally comprises blade 410 mounted to backing member 411. Wheel mount assembly 413 is pivotally mounted to backing member 411 using pivot bolt 412. Gauge wheels 414, which are designed to ride over an underlying surface, are operationally attached to wheel mount assembly 413 using axle mount member 415.

An elevation fluid powered cylinder assembly 300 has an upper end 301 and a lower end 302. Said upper end 301 of said master fluid powered cylinder assembly 300 is pivotally attached to a pivot mounting member 330 using pivot bolt 336. Pivot mounting member 330 is, in turn, pivotally mounted to grader blade assembly 400 using pivot bolt 337. Lower end 302 of master elevation fluid powered cylinder 300 is pivotally attached to wheel mount assembly 413 using pivot bolt 313.

A tilt fluid powered cylinder assembly 500 has an upper end 501 and a lower end 502. Said upper end 501 of said tilt fluid powered cylinder assembly 500 is pivotally attached to pivot mounting member 330 using pivot bolt 523. Lower end 502 of tilt fluid powered cylinder 500 is fixedly attached to grader blade assembly 400 using mounting bracket 524. Although not depicted in FIG. 5, it is to be observed that multiple groupings of cylinder assemblies and pivot mounting members can be arrayed in parallel alignment.

Such multiple arrays of elevation and tilt cylinder assemblies are connected to hydraulic fluid control lines as generally depicted in FIG. 4. As such, the view depicted in FIG. 5 (with one elevation cylinder and one tilt cylinder) is essentially equivalent to the left half of FIG. 4. The cylinders depicted on the right half of FIG. 4, although not shown in FIG. 5, are similarly configured.

Figure 6:
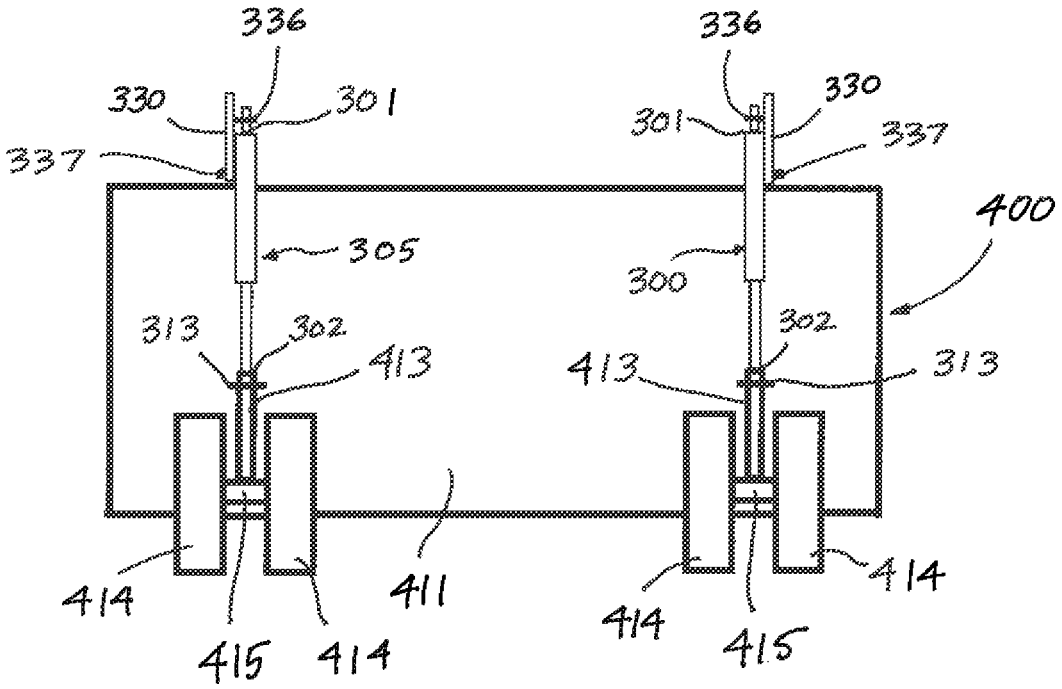
FIG. 6 depicts a rear view of an alternative embodiment of an earth moving grader assembly equipped with the tandem phasing cylinder assembly of the present invention.

FIG. 6 depicts a rear view of alternative embodiment earth moving grader assembly 400 equipped with the tandem phasing cylinder assembly of the present invention. Grader blade assembly 400 generally comprises a blade 410 (not shown in FIG. 6) mounted to backing member 411. Wheel mount assemblies 413 are pivotally mounted to backing member 411, and can pivot up or down relative to said backing member 411. Gauge wheels 414, which are designed to ride over an underlying surface, are operationally attached to wheel mount assemblies 413 using axle mount member 415.

Still referring to FIG. 6, elevation master fluid powered cylinder assembly 300 and elevation slave fluid powered cylinder 305 each have an upper end 301 and a lower end 302. Said upper ends 301 of elevation master fluid powered cylinder assembly 300 and elevation slave fluid powered cylinder assembly 305 are each pivotally attached to pivot mounting members 330 using pivot bolts 336. Pivot mounting members 330 are, in turn, pivotally mounted to grader blade assembly 400 using pivot bolts 337. Lower ends 302 of elevation master fluid powered cylinder 300 and elevation slave fluid powered cylinder assembly 305 are each pivotally attached to a wheel mount assembly 413 using a pivot bolt 313.

Figure 7:
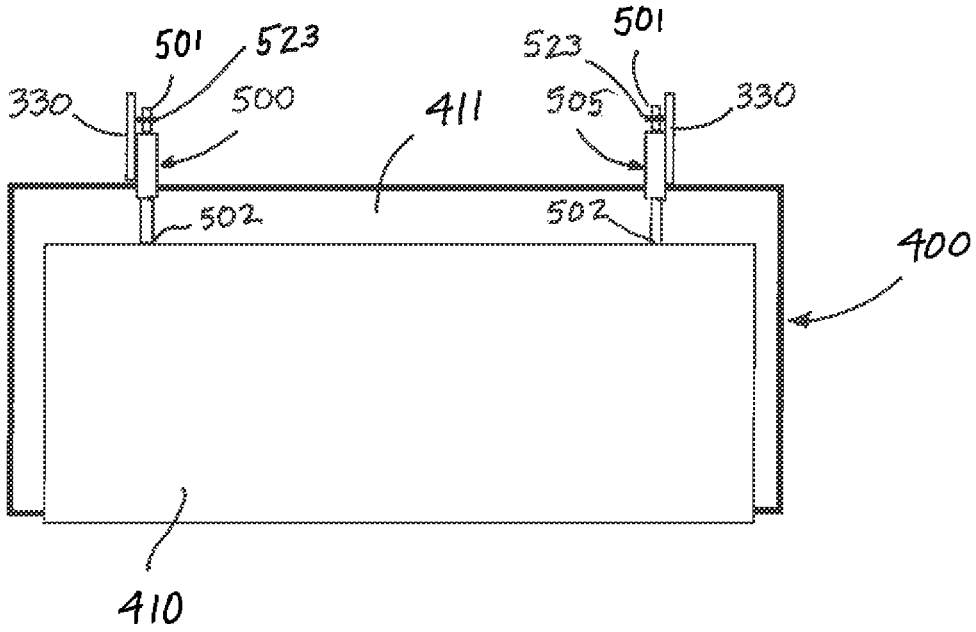
FIG. 7 depicts a front view of an alternative embodiment of an earth moving grader assembly equipped with the tandem phasing cylinder assembly of the present invention.

FIG. 7 depicts a front view of an alternative embodiment of an earth moving grader assembly 400 equipped with the tandem phasing cylinder assembly of the present invention. Grader blade 410 is mounted to backing member 411. Master tilt fluid powered cylinder assembly 500 and slave tilt fluid powered assembly 505 each have an upper end 501 and a lower end 502. Said upper ends 501 of said master tilt fluid powered cylinder assembly 500 and slave tilt fluid powered cylinder assembly 505 are each pivotally attached to pivot mounting members 330 using pivot bolts 523. Lower ends 502 of tilt fluid powered cylinders 500 are each fixedly attached to grader blade 410. Both master elevation fluid powered cylinder assembly 300 and slave elevation fluid powered cylinder assembly 305 can be extended or retracted in tandem as discussed in greater detail above. Such tandem extension or retraction of said master and slave elevation fluid powered cylinder assemblies 300 and 305 permits blade member 410 to be selectively raised or lowered relative to an underlying work surface. Similarly, both master tilt fluid powered cylinder assembly 500 and slave tilt fluid powered cylinder assembly 505 can be extended or retracted as discussed in greater detail above. Such tandem extension and/or retraction of said master and slave tilt fluid powered cylinder assemblies 500 and 505 permits blade member 410 to be selectively tilted from side to side relative to said underlying work surface.

The tandem phasing hydraulic assembly of the present invention consistently maintains a condition of having an exact elevation and slope demand, even with a heavy, one-sided material load on a blade. By contrast, conventional double-action cylinders are highly susceptible to failure under such uneven loading condition. As a result, the tandem phasing hydraulic assembly of the present invention is faster and can move more material over a longer distance than a conventional dozer or motor grader, even though said conventional dozers and motor graders may be equipped with an identical machine control system. In other words, tandem phasing hydraulic assembly of the present invention can be used with conventional machine control systems.

Further, the tandem phasing hydraulic assembly of the present invention can have multiple alternative embodiments or configurations in order to accommodate a variety of ground surface conditions and/or intended uses. For example, in subdivision or road grading, the tandem phasing hydraulic assembly of the present invention can have a plurality of active cylinders that operate independently from one another that move in an upward and downward motion, thereby providing a steep tilt. Alternatively, in an agricultural context, the tandem phasing hydraulic assembly of the present invention can have an active cylinder on one side and a blanked-out, inactive cylinder on an opposite side, thereby providing only half of the tilt when a less aggressive tilt is needed.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for controlling the positioning of a blade of an earth moving machine comprising:

a) a first master fluid powered cylinder assembly comprising:
   i) a first master cylinder barrel defining a first inner chamber, and having a first fluid inlet and a first fluid outlet;
   ii) a first master piston moveably disposed within said first master cylinder barrel;
   iii) a first master rod operationally connected to said first master piston;

b) a first slave fluid powered cylinder assembly comprising:
   i) a first slave cylinder barrel defining a second inner chamber, and having a second fluid inlet and a second fluid outlet;
   ii) a first slave piston moveably disposed within said first slave cylinder barrel;
   iii) a first slave rod operationally connected to said first slave piston;

c) a second master fluid powered cylinder assembly comprising:
   i) a second master cylinder barrel defining a third inner chamber, and having a third fluid inlet and a third fluid outlet;
   ii) a second master piston moveably disposed within said second master cylinder barrel;
   iii) a second master rod operationally connected to said second master piston;

d) a second slave fluid powered cylinder assembly comprising:
   i) a second slave cylinder barrel defining a fourth inner chamber, and having a fourth fluid inlet and a fourth fluid outlet;
   ii) a second slave piston moveably disposed within said second slave cylinder barrel;
   ii) a second slave rod operationally connected to said second slave piston;

e) a first conduit connecting said first fluid outlet of said first master cylinder barrel with said second fluid inlet of said first slave cylinder barrel, wherein fluid flowing out of said first master cylinder barrel of said first cylinder assembly flows into said first slave cylinder barrel, and wherein said first master rod and said first slave rod operate in tandem phased relationship;

f) a second conduit connecting said third fluid outlet of said second master cylinder barrel with said fourth fluid inlet of said second slave cylinder barrel, wherein fluid flowing out of said second master cylinder barrel of said second cylinder assembly flows into said second slave cylinder barrel, and wherein said second master rod and said second slave rod operate in tandem phased relationship; and g) a yoke member pivotally connected to said earth moving machine, wherein said first master cylinder assembly, first slave cylinder assembly, second master cylinder assembly and second slave cylinder assembly are pivotally attached to said yoke member.

2. The apparatus of claim 1, wherein said first master, first slave, second master and second slave cylinder assemblies are disposed on said earth moving machine having said blade.

3. The apparatus of claim 2, wherein said first master and said first slave cylinder assemblies each have a first end and a second end, wherein said first ends of said first master and first slave cylinder assemblies are operationally connected to said yoke member and said second ends of said first master and first slave cylinder assemblies are operationally connected to said blade.

4. The apparatus of claim 2, wherein said second master and said second slave cylinder assemblies each have a first end and a second end, wherein said first ends of said second master and second slave cylinder assemblies are operationally connected to said yoke member and said second ends of said second master and second slave cylinder assemblies are operationally connected to said earth moving machine.

5. The apparatus of claim 1, wherein said first master cylinder assembly and said first slave cylinder assembly operate in tandem phased relationship.

6. The apparatus of claim 5, wherein said first master cylinder assembly and said first slave cylinder assembly extend or retract together.

7. The apparatus of claim 6, wherein said first master cylinder assembly and first slave cylinder assembly are adapted to adjust an elevation of said blade relative to an underlying surface.

8. The apparatus of claim 1, wherein said second master cylinder assembly and said second slave cylinder assembly operate in tandem phased relationship.

9. The apparatus of claim 8, wherein said second master cylinder assembly extends when said second slave cylinder assembly retracts.

10. The apparatus of claim 9, wherein said second master cylinder assembly and second slave cylinder assembly are adapted to change side-to-side tilt of said blade relative to an underlying surface.

11. The apparatus of claim 1, further comprising a first supply conduit adapted to supply fluid to said first master cylinder barrel.

12. The apparatus of claim 11, wherein flow of said fluid through said first supply conduit is controlled by a servo valve.

13. The apparatus of claim 11, further comprising a second supply conduit adapted to supply fluid to said second master cylinder barrel.

14. The apparatus of claim 13, wherein flow of said fluid through said second supply conduit is controlled by a servo valve.

15. The apparatus of claim 1, wherein said earth moving machine comprises a motor grader.

16. The apparatus of claim 1, wherein said first master cylinder barrel and said first slave cylinder barrel each have a plurality of re-phasing ports.

17. The apparatus of claim 1, wherein said second master cylinder barrel and said second slave cylinder barrel each have a plurality of re-phasing ports.

* * * * *